United States Patent [19]

Kristof et al.

[11] Patent Number: 4,621,180

[45] Date of Patent: Nov. 4, 1986

[54] CAVITY ILLUMINATION MEANS FOR MICROWAVE OVEN

[75] Inventors: Mark J. Kristof, Marion Township, Marion County; Donald J. Spencer, Pleasant Township, Franklin County, both of Ohio

[73] Assignee: Whirlpool Corporation, Benton Harbor, Mich.

[21] Appl. No.: 752,817

[22] Filed: Jul. 8, 1985

[51] Int. Cl.[4] ..... H05B 6/64; F21V 33/00

[52] U.S. Cl. ..... 219/10.55 R; 219/10.55 E; 219/10.55 D; 362/92

[58] Field of Search ..... 219/10.55 B, 10.55 R, 219/10.55 E, 10.55 D; 174/35 R, 35 MS; 362/92, 94

[56] References Cited

U.S. PATENT DOCUMENTS

| | | | |
|---|---|---|---|
| 2,993,973 | 7/1961 | Johnson et al. | 219/10.55 R |
| 3,195,013 | 7/1965 | Thal, Jr. | 219/10.55 B |
| 3,339,054 | 8/1967 | Deaton | 219/10.55 B |
| 4,254,450 | 3/1981 | White et al. | 362/92 |
| 4,410,779 | 10/1983 | Weiss | 219/10.55 R X |
| 4,485,285 | 11/1984 | Machesney | 219/10.55 D |
| 4,559,585 | 12/1985 | Almgren et al. | 219/10.55 R X |

*Primary Examiner*—Philip H. Leung

*Attorney, Agent, or Firm*—Hill, Van Santen, Steadman & Simpson

[57] ABSTRACT

Apparatus for illuminating the interior of a microwave oven cooking cavity, including a light bulb and socket assembly that are inserted into the cavity interior through an opening in a side wall of the cavity during assembly of the oven and a metallic shield member mounted to the cavity wall to surround the bulb. The shield is dimensioned to permit user access to the bulb from within the cavity while preventing the propagation of microwave energy to the region where the bulb is located.

7 Claims, 8 Drawing Figures

CAVITY ILLUMINATION MEANS FOR MICROWAVE OVEN

BACKGROUND OF THE INVENTION

1. Field of the Invention

The present invention relates to an illumination means for a microwave oven cooking cavity and more specifically to an illumination means mounted within the cooking cavity.

2. Description of the Prior Art

Microwave ovens designed for home and commercial use in heating food items require a carefully designed and constructed cabinet structure enclosing the cooking cavity in order to ensure uniform heating throughout the cavity and to avoid leakage of microwave radiation. Since the operator of such an oven must have easy access to the interior of the cavity, a door is generally provided on the front side of the cavity. Further, it is desirable to permit the user to view the interior of the cooking cavity with the door closed, and thus the doors are provided with a transparent, yet shielded area which permits viewing through the door while preventing microwave leakage. Also, a lamp is used to provide illumination within the cavity.

In previous microwave cavity constructions, the lamp is generally mounted on the exterior of the cavity and the light is permitted to enter the cavity through a "window" comprising a plurality of small perforations in the cavity wall. The main reason for mounting the light bulb on the exterior of the cooking cavity is that microwave energy destroys the filaments in a light bulb very quickly and an unprotected bulb would be useless in that it would immediately burn out each time the oven was used. Further, the wiring connecting the bulb with a power source would act as an antenna to radiate microwave energy out of the cooking cavity.

When the light bulb is placed on the exterior of the cooking cavity, not all of the light from the bulb is directed into the cavity, since only the portion of light radiating toward the openings in the cavity wall can enter the cavity. Thus, the wattage of the bulb must be selected which would be sufficient to illuminate the entire cavity to a predetermined level. Such a wattage is necessarily greater than if the bulb were able to be placed within the cavity.

To access an exteriorly mounted bulb for changing, it is generally necessary to remove at least a portion of the outer cover of the oven enclosure. The portion which must be removed is either an outer wrapper or a portion of the back panel. In either case, such a procedure generally requires movement of the microwave oven and perhaps surrounding items.

Often microwave ovens are built into adjoining cabinetry in a kitchen and, when the light bulb is accessible only from the side or rear of the oven, it is necessary to completely remove the oven from the cabinetry in order to change the bulb. Clearly this is a time consuming and difficult operation since microwave ovens are bulky and fairly heavy, sometimes making the changing of a light bulb a project requiring two people.

When the light bulb is placed on the exterior of the cooking cavity, it may not be in the flow path of air which is circulated through the oven. This could lead to a higher than desirable operating temperature for the bulb with a resulting shortened life for the bulb. In such case, the extra effort required for changing the bulb occurs that much more often. This situation is compounded due to the fact that the wattage of the bulb, and thus the heat generated, is increased to provide adequate illumination within the oven cavity.

SUMMARY OF THE INVENTION

The present invention provides a construction arrangement for illuminating the cooking cavity within a microwave oven in which the light bulb is positioned within the interior of the cooking cavity and is protected by a metal lamp shield. The lamp and socket assembly are insertable into the cooking cavity through an enlarged opening in a top panel of the cavity which greatly assists in the assembly of the light to the cavity.

The lamp shield protects the light bulb from the microwave energy in that it forms a tube which prevents the propagation of microwave radiation. The shield is open at both ends and is perforated along its length permitting visible light to radiate outwardly into the cavity.

A translucent cover is secured adjacent the top panel within the cooking cavity to further enclose the lamp and to defuse light throughout the cooking cavity. The cover has a front hinged panel which can be opened to provide direct access to the light bulb from the interior of the cooking cavity to permit the light bulb to be easily and readily changed.

By placing the light bulb within the interior of the cooking cavity, all of the illumination of the bulb is directed within the cavity allowing for a smaller wattage bulb to be used. A portion of the air flow through the cooking cavity flows past the light bulb to cool the bulb and to prevent overheating.

Because the bulb and socket are insertable through the top of the top panel of the cooking cavity and are secured to the top panel by a pair of screws from the top side, assembly costs are greatly reduced.

The lamp shield comprises a cylindrical perforated metal tube opened along one side with flanges along the opening so that the flanges can be secured directly to the top cooking cavity panel. The shield is designed in accordance with known wave propagation formulas so that the microwave energy is highly attenuated at the openings at either end of the shield. Thus, the level of microwave energy decreases very rapidly from the open end of the tube toward the opposite end of the tube.

The arrangement of the bulb, shield, and translucent cover is such that the bulb can be readily changed from within the oven cavity, without the need to remove a portion of the outer cabinet.

DESCRIPTION OF THE PREFERRED EMBODIMENT

Figure 1:
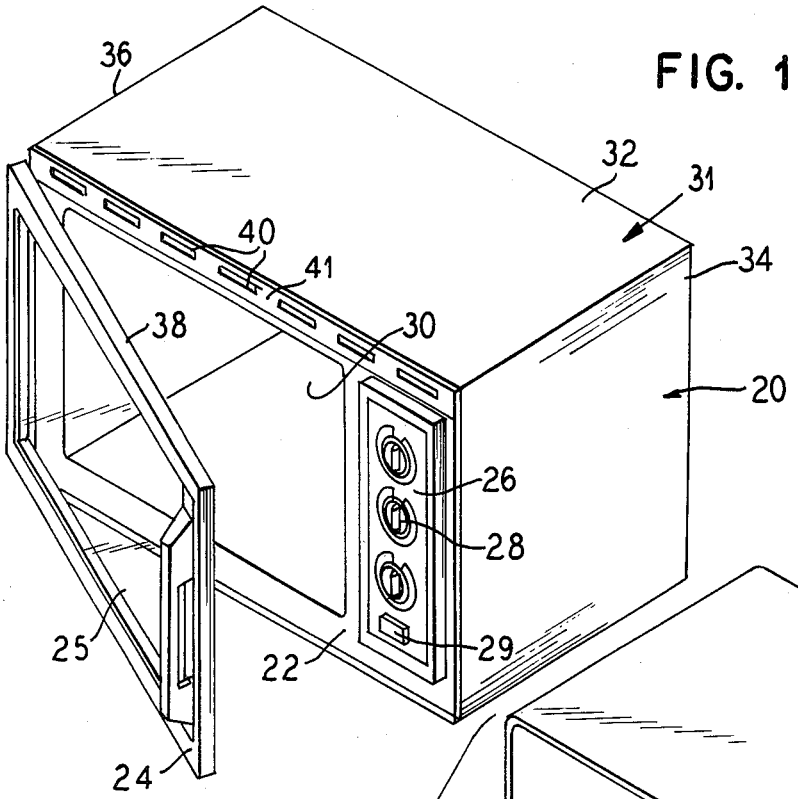
FIG. 1 is a perspective view of a microwave oven embodying the principles of the present invention.

In FIG. 1 there is shown a microwave oven generally at 20 having a front panel 22 with an openable hinged door 24 having a generally transparent central area 25 and a control panel 26 with a plurality of controls 28 for setting the parameters of the heating cycle to be performed by the oven, as well as a push button switch 29 for energizing a lamp within a cooking cavity 30. The hinged door 24 opens to expose a cooking cavity 30.

A removable wrapper 31 forms a finished and aesthetically pleasing appearance for a top outer surface 32 and opposed end outer surfaces 34, 36 of the microwave oven cabinet. Located on the front panel 22 above a top edge 38 of the door 24 are a plurality of air vents 40 which provide an opening for air which is forced through the interior of the oven 20. A removable grill 41 covers the air vents 40 resulting in a pleasing appearance of the front panel 22.

Figure 2:
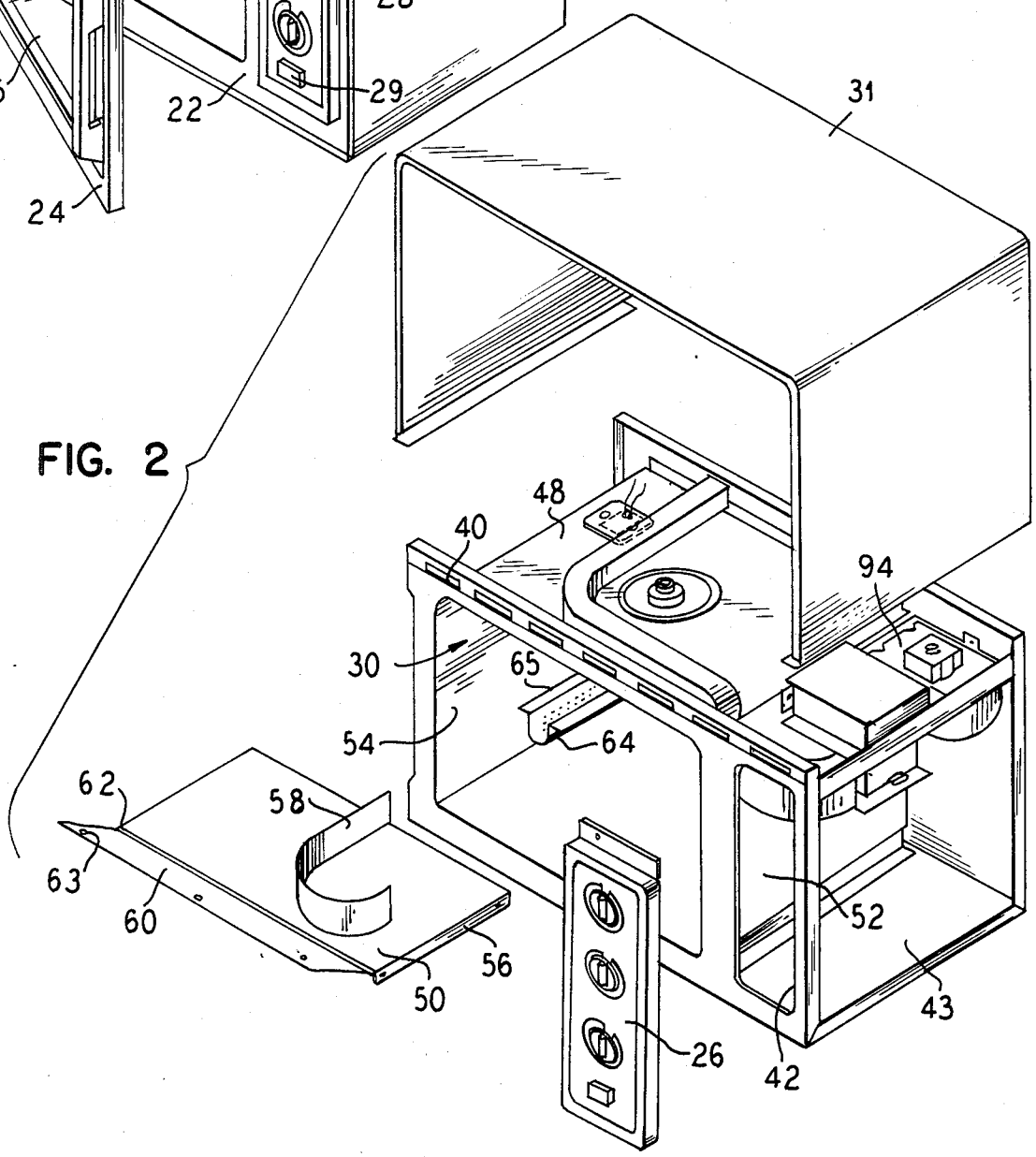
FIG. 2 is a perspective exploded view of the microwave oven cabinet of FIG. 1.

In FIG. 2, outer portions of the microwave oven 20 have been detached, such as the wrapper 31, and the control panel 26. The door 24 has been completely removed. It is seen that the front panel 22 has an opening 42 to provide access for the rear portions of the controls 28 to extend into a chamber 43 which houses substantially all of the electrical components for the microwave oven. For clarity, a number of electrical components have been removed from the interior of the cabinet behind the control panel area in this figure.

Shown in partial disassembly is a protective cover 50 which is placed within the cooking cavity 30 and is made of a translucent material to permit light from a lamp or light bulb 68 (FIGS. 3–7) to shine through the cover 50 to the interior of the cooking cavity 30. The cover 50 attaches to a pair of opposed side panels 52, 54 of the cooking cavity by means of flanges 56 on the edges of the cover so that an upstanding wall 58 on the top side of the cover 50 abuts against a top panel 48 of the cooking cavity 30. The wall 58 surrounds a paddle, or stirrer blade, (not shown) which is used to "stir" the microwave energy within the cooking cavity to enhance the distribution of that energy.

A front panel 60 of the cover 50 is hinged at 62 and is provided with a plurality of fastening means 63 such as screws so that it can be selectively opened downwardly to provide access to the light bulb 68 (FIG. 3) for changing purposes without necessitating the removal of the entire cover 50. Thus, the paddle is continuously protected by the upstanding wall 58 even while the user changes the light bulb 68. The fastening means 63 are received in small openings in the top panel 48 of the cooking cavity 30.

Also shown in partial disassembly in FIG. 2 is a shield 64 which covers the light bulb 68 and which attaches along a pair of flat flange portions 65 directly to the bottom side of the top panel 48 of the cooking cavity. The shield 64 is shown in its preferred configuration which is a cylinder opened along one side to form the mounting flanges 65.

Figure 3:
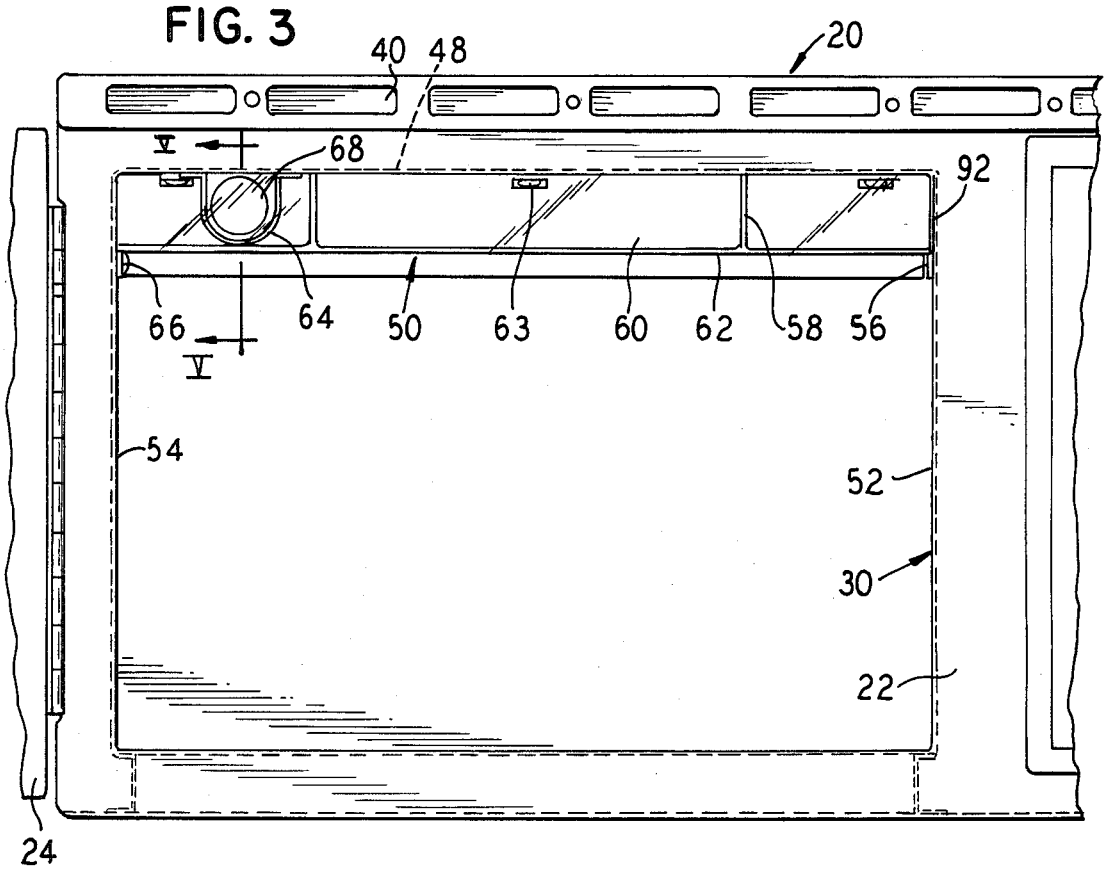
FIG. 3 is a front view of the microwave oven cooking cavity showing of the lamp.

FIG. 3 shows a front view of the cooking cavity 30 with the door 24 in the open position where it is seen that the cover 50 is attached to the side walls 52, 54 by appropriate fastening means such as screws 66. The lamp shield 64 is seen through the translucent cover 50 as being secured directly to the top panel 48 of the cooking cavity. Mounted within the shield 64 is a light bulb 68. Alternatively, the light bulb 68 and shield 64 could be mounted on one of the side walls 52, 54 or a rear wall 69 (FIG. 5) of the cooking cavity.

Figure 4:
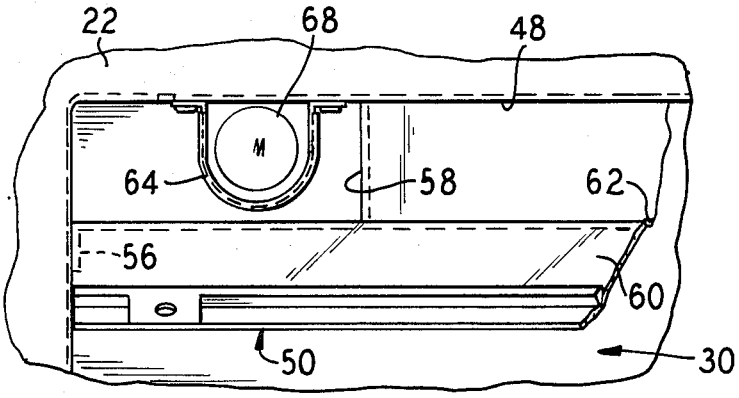
FIG. 4 is a partial front view of the lamp mounting location.

FIG. 4 is a partial front view with the front panel 60 of the cover 50 pivoted downwardly along hinge 62 to expose the light bulb 68 and lamp shield 64. It is seen that there is direct access to the light bulb 68 from the front of the cooking cavity 30 when the cover panel 60 is pivoted downwardly. The shield 64 has a diameter sufficiently greater than the bulb to permit a user to manually engage the bulb 68 and to twistingly remove it without removing the shield. It is also seen that the upstanding wall 58 of the cover 50 extends between the horizontal cover wall and the top panel 48 of the cooking cavity to provide an effective shield for the stirrer blade. Since the front panel 60 of the cover 50 is hinged and held in an upward position only for aesthetic reasons rather than functional reasons, there is no loss of function or increased risks due to radiation leakage if the user forgets or fails to completely reassemble the cover after changing a light bulb.

Figure 5:
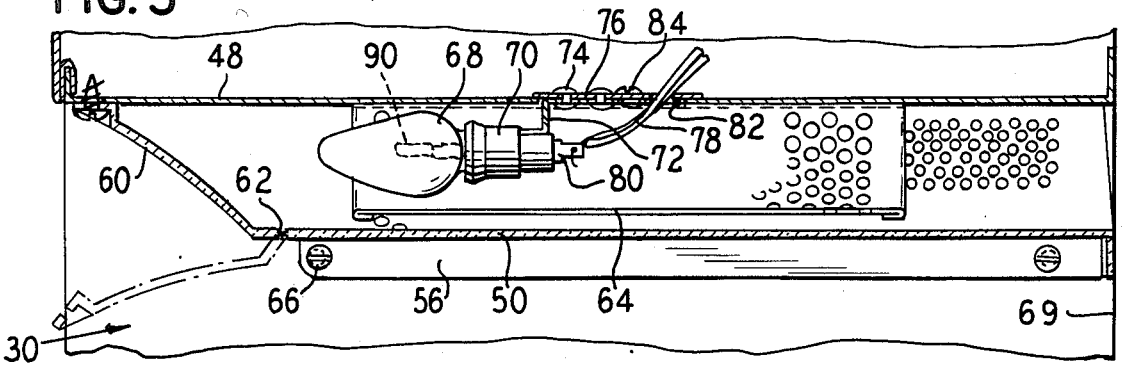
FIG. 5 is a side sectional view of the lamp mounting location taken generally along the line V—V of FIG. 3.

FIG. 5 is a side sectional view taken generally along the line V—V of FIG. 3 and shows in greater detail the placement of the light bulb 68 within the lamp shield 64. The light bulb 68 is mounted directly in a bulb socket 70 carried on a bracket arm 72 which is secured by rivets 74 to a mounting plate 76. A pair of wires 78 are attached to a pair of base end connectors 80 to provide an electrical connection for the light bulb 68. The wires pass through an opening 82 in the mounting plate 76 to pass to the exterior of the cooking cavity 30. A pair of screws 84 secure the mounting plate 76 to the top panel 48 of the cooking cavity 30.

Figure 6:
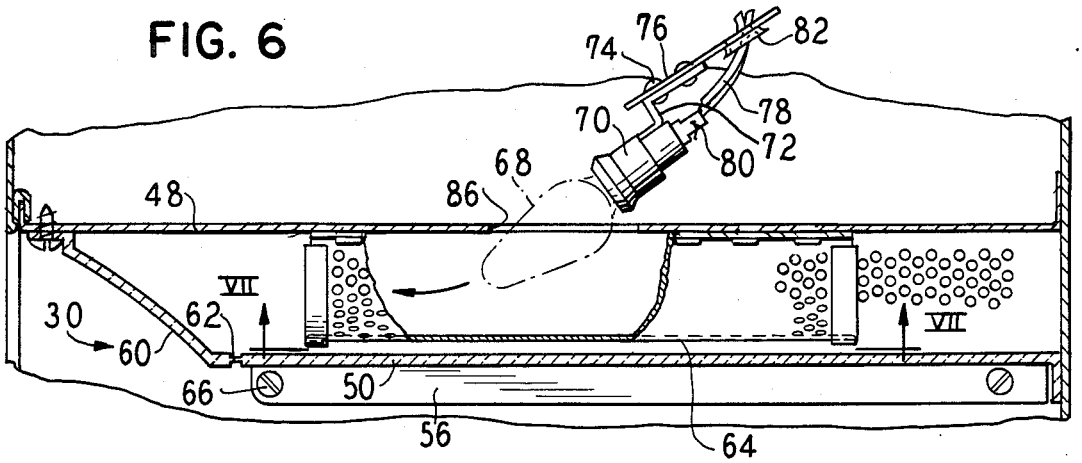
FIG. 6 is a side sectional view illustrating insertion of the lamp into the cooking cavity.

FIG. 6 illustrates the insertion of the light bulb 68 and socket assembly into the interior of the cooking cavity 30. An enlarged opening 86 is provided in the top panel 48 directly over the location of the lamp shield 64. The opening 86 is large enough for the light bulb 68 as well as the socket 70 to pass through. The mounting plate 76 is larger than the opening 86 and thus rests on top of the opening. When the mounting plate is pressed against the top panel 48, it can be secured in place by the pair of screws 84.

Figure 7:
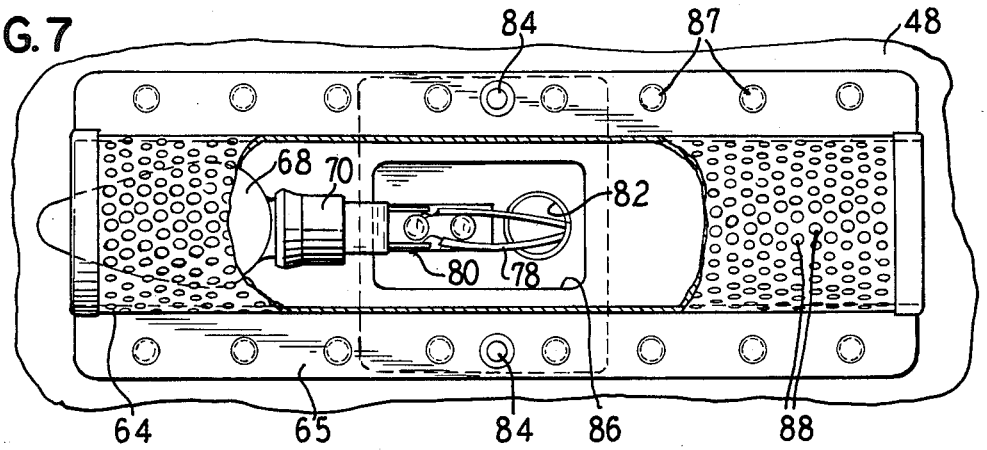
FIG. 7 is a top view of the lamp and shield mounting location.

FIG. 7 is a bottom view of the lamp shield 64 taken generally along the lines VII—VII of FIG. 6 and it illustrates the final placement of the light bulb 68 within the shield 64. The dimensions of the enlarged opening 86 are shown as well as the socket mounting arrangement. Also clearly illustrated are fastening means 87 comprising metal stitches which are used to secure the lamp shield 64 to the top panel 48. Since the bulb 68 can be removed and replaced without removing the shield 64, metal stitches can be used which permanently secure the shield to the adjoining panel.

It is known that slots having a width less than $\frac{1}{4}$ of a wavelength effectively prohibit propagation of a wave through the slot. The fastening stitches 87 provide a metal to metal contact between the shield 64 and the top panel 48 and effectively form slots between the top panel 48 and the flange area 65 of the lamp shield 64. Therefore, it is necessary to space the stitches 87 less than $\frac{1}{4}$ of a wavelength apart. The microwave energy commonly used in a microwave oven has a wavelength of approximately 12.63 cm (approximately 5") and therefore a spacing of approximately 2.5 cm (approximately 1") will effectively prevent the propagation of microwave energy between the adjoining stitches 87.

The shield 64 is provided with a plurality of spaced perforations 88 which are small enough individually to prevent propagation of microwave energy therethrough but are large enough in number and size to permit visible light energy from the light bulb 68 to pass through and illuminate the interior of the cooking cavity 30. The wavelengths for visible light range from 0.00004 to 0.00008 cm, thus the small holes permit propagation of visible light but prevent propagation of microwaves. The front open end of the shield 64 is dimensioned to prevent effective transmission of the microwave energy into the space interior of the shield. Wave propagation through a tube is a known phenomenon and formulas are available to calculate cut off dimensions for wave propagation. See, for example, R. Collin, *Field Theory of Guided Waves* (McGraw-Hill, 1960), and N. Marcuvitz, *Waveguide Handbook* (McGraw-Hill, 1951).

Although the shield 64 is shown in its preferred configuration, being a cylinder open along its length, it could also be formed in other configurations such as a square or rectangular tube, so long as the dimensions of the open ends are such that the propagation of microwave energy through the space formed interiorly of the shield is prevented. A cylindrical shape minimizes the size of the opening while permitting sufficient access to the light bulb for easy removal and replacement. It has been found that a radius of 18 cm for the opening effectively prevents the propagation of microwave energy into the tube such that a filament 90 of the light bulb is not affected by the microwaves.

Figure 8:
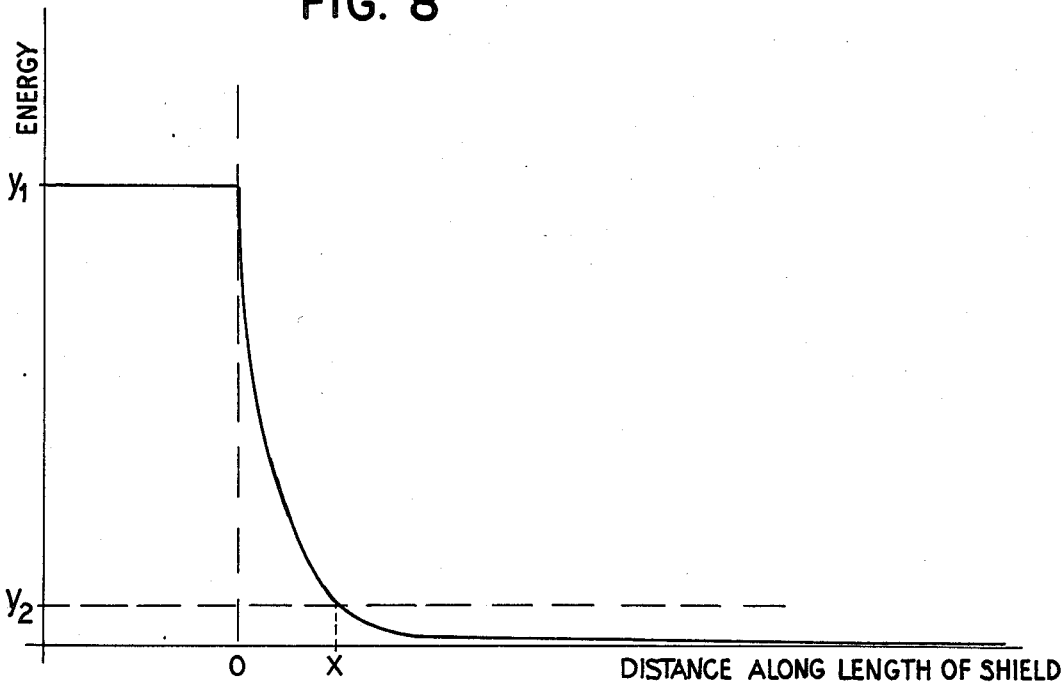
FIG. 8 is a graph illustrating how the level of microwave energy varies along the length of the light shield.

As shown in FIG. 8, the microwave energy level within the cooking cavity is represented by an energy level Y1 which is fairly constant. Starting at a point indicated to be distance 0, representing the open end of the shield 64, the energy level drops off very rapidly and drops below a level Y2 within a very short distance X from the front opening of the shield. The distance 0–X represents a distance less than the distance from the front opening of the shield 64 to the light bulb filament 90. The energy level Y2 represents a level which is insufficient to cause any damage to the bulb filament.

Because of the rapid attenuation of the microwave energy within the interior of the lamp shield 64 it is possible to provide the enlarged opening 86 in the top panel 48 without requiring that the opening be specially sealed or otherwise protected. Normally, the provision of such an opening in a panel of a microwave oven cooking cavity would be impossible since leakage through the opening would be grossly excessive.

Further, because of the effect of the shield 64, the microwave energy is not transmitted to the light bulb wires 78 thereby removing any concern about microwave leakage or transmission over those wires.

By placing the light bulb 68 entirely within the cooking cavity 30, the entirety of the light energy generated by the light bulb is radiated and reflected into the cooking cavity thereby reducing the wattage required for the light bulb 68 compared to similar bulbs mounted exteriorly of the cooking cavity. This reduced wattage results in a cooler burning light bulb.

Also, by placing the light bulb within the cooking cavity, the bulb can be cooled by the air flow which is directed through the cooking cavity. This further enhances the life of the bulb.

Because the light bulb 68 can be accessed from the front of the microwave oven when the door 24 is opened, it is not necessary to remove any exterior panels of the oven cabinet and, if the oven is built into adjoining kitchen cabinetry, it is not necessary to remove the oven from that cabinetry. Thus, replacement of the light bulb is eased significantly over mounting arrangements which require access through exterior panels.

It is thus seen that there is provided a cavity illumination means for a microwave oven which includes the mounting and shielding of a light bulb within the cooking cavity which permits easy access to the bulb, a lower wattage for the bulb and cooling for the bulb, thus enhancing the use and lowering the cost of the microwave oven.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contributions to the art.

The embodiments of the invention in which an exclusive property or privilege is claimed are defined as follows:

1. In a microwave oven having a cooking cavity defined by cavity walls into which microwave energy is selectively introduced, cavity illumination means comprising:

an illuminating light bulb;

an opening in one of said cavity walls;

a mounting plate carrying a light bulb socket on one side thereof;

said opening being sufficiently large to receive said light bulb and light bulb socket therethrough from the outside thereof, but being smaller than said mounting plate, such that said mounting plate will be held on the outside of said cavity wall; and means shielding said light bulb from microwave energy within said cavity;

said shielding means having an opening therein sufficiently large to permit manual access to said light bulb from the interior of said cavity;

whereby, said light bulb is carried on said mounting plate by means of said socket and can be assembled to said cavity from the exterior of said cavity through said opening and said light bulb is readily accessible from the interior of said cavity for replacement purposes.

2. A microwave oven according to claim 1 wherein said shield comprises a tube into which said light bulb is insertable, said tube being metallic and having an open end dimensioned to substantially prevent the propagation of microwave energy into said tube to the region where said bulb is located.

3. A microwave oven according to claim 2 wherein said shield has a plurality of small perforations along its length closely spaced and being dimensioned to prevent the propagation of microwave energy into said tube while permitting the propagation of visible light energy from said tube.

4. A microwave oven according to claim 1 including a translucent cover surrounding said light bulb and shielding means within said cavity, said cover being openable to provide access to said light bulb from the interior of said cavity.

5. In a microwave oven having a cooking cavity defined by cavity walls into which microwave energy is selectively introduced, cavity illumination means comprising:

an illuminating light bulb;

an opening in one of said cavity walls;

a mounting plate with means for carrying said light bulb;

said opening being sufficiently large to receive said light bulb therethrough from the exterior thereof, but being smaller than said mounting plate, such that said mounting plate is securable to the exterior of said cavity wall;

a microwave energy shield mounted on the interior of said cavity wall;

said light bulb being received in said shield upon insertion through said opening;

said shield having an opening therein providing access to said light bulb from the interior of said cavity;

whereby, said bulb may be assembled to said cavity from the exterior thereof, and may be removed from said cavity from the interior thereof.

6. A microwave oven according to claim 5 wherein said shield member comprises a tube with open ends and a flanged opening along its length, said open ends providing access to said light bulb and said flanges engagable with a wall of said cooking cavity.

7. A microwave oven according to claim 6 wherein said shield member further includes a plurality of small spaced holes along its length to permit transmission of visible light energy.

* * * * *